US007971807B2

(12) United States Patent
Iijima et al.

(10) Patent No.: US 7,971,807 B2
(45) Date of Patent: Jul. 5, 2011

(54) GAS JET NOZZLE

(75) Inventors: Kazuo Iijima, Saitama (JP); Makoto Itou, Isesaki (JP)

(73) Assignee: Air Water Sol Inc. (JP)

( * ) Notice: Subject to any disclaimer, the term of this patent is extended or adjusted under 35 U.S.C. 154(b) by 149 days.

(21) Appl. No.: 12/322,083

(22) Filed: Jan. 29, 2009

(65) Prior Publication Data

US 2009/0223016 A1 Sep. 10, 2009

(30) Foreign Application Priority Data

Feb. 26, 2008 (JP) ..... 2008-043686
Nov. 17, 2008 (JP) ..... 2008-292885

(51) Int. Cl.
*B05B 1/00* (2006.01)
*B08B 5/00* (2006.01)
*B08B 5/02* (2006.01)

(52) U.S. Cl. ..... 239/419.5; 239/DIG. 13; 239/DIG. 21; 15/300.1; 15/405

(58) Field of Classification Search ..... 15/300.1, 15/316.1, 405, 406, 408; 239/270, 337, 391, 239/418, 419, 419.5, DIG. 13, DIG. 21, DIG. 22
See application file for complete search history.

(56) References Cited

U.S. PATENT DOCUMENTS 2,645,528 A * 7/1953 Thorsen ..... 239/417.3
3,647,142 A * 3/1972 Drude et al. ..... 239/288.3

* cited by examiner

*Primary Examiner* — Darren W Gorman
(74) *Attorney, Agent, or Firm* — Wood, Phillips, Katz, Clark & Mortimer

(57) ABSTRACT

A gas jet nozzle 1 is provided that has a relatively simple mechanism capable of jetting high-pressure gas for a long period. The nozzle 1 jets high-pressure gas from a high-pressure gas bottle 12. The nozzle 1 has a jet port 2 for jetting high-pressure gas by communicating with the gas bottle 12. The nozzle 1 further has a jet passage 3 for directing to a target the gas jetted from the jet port 2 and jetting the directed gas from the front end 4 of the passage. The nozzle 1 includes an air suction part 5 for sucking atmospheric air into the gas jetted from the jet port 2.

2 Claims, 6 Drawing Sheets

GAS JET NOZZLE

FIELD OF THE INVENTION

The present invention relates to a gas jet nozzle for jetting the high-pressure gas filled into a bottle.

BACKGROUND OF THE INVENTION

Dust blowers have been used widely to blow dust from precision machines, negative film, etc. In general, a dust blower includes an aerosol spraying can and a valve. The spraying can is filled with liquefied gas as propellant under high pressure and fitted with a nozzle at its top. The nozzle functions as a jet button for opening and closing the valve. A blowout tube is connected to the front end of the nozzle. The dust blower jets gas through the blowout tube to a spot. When the jet button is pressed, the valve is opened, so that the gas in the spraying can passes through the valve and jetted out through the nozzle and the blowout tube.

The liquefied gas may be HFC(hydrofluorocarbon)134a or HFC152a as alternate flon, or DME (dimethyl ether). The liquefied gas is kept under high pressure in the spraying can.

When HFC134a and HFC152a are released into the atmosphere, they cause the greenhouse effect. For this reason, HFC134a and HFC152a are listed as greenhouse effect gasses restricted in output in the Kyoto Protocol adopted to achieve the purpose of the Framework Convention on Climate Change, and the whole industry has been promoting the reduction in the output of HFC134a and HFC152a. For example, the greenhouse effect of HFC134a is 1,300 times more than the greenhouse effect of carbon dioxide, and the greenhouse effect of HFC152a is 140 times more than the greenhouse effect of carbon dioxide. For this reason, it has been demanded that HFC products be replaced by products for use with other compressed gas.

DME, which has a low global warming potential, is combustible gas. And HFC152a is combustible gas, too. These gasses cannot be used for electronic circuit boards and other parts that must be non-combustible.

A dust blower has been proposed that includes a high-pressure liquefied gas bottle filled with liquefied carbonic acid gas, nitrogen gas, or the like in place of HFC.

Patent document 1: JP 2005-249192 A

This dust blower can be used with non-combustible gas having a low global warming potential. However, the high-pressure liquefied gas bottle is expensive, and the gas in it is consumed in a relatively short time. As a result, it is necessary to frequently replace the expensive bottle. The replacement is troublesome and costly.

Another dust blower has been proposed, which includes a high-pressure liquefied gas bottle and is fitted with a pressure reducing mechanism for jetting high-pressure gas while reducing the pressure of the gas in order to lengthen the life of the bottle. Because the pressure reducing mechanism is complex, the dust blower is large and costly.

SUMMARY OF THE INVENTION

The object of the present invention is to provide a gas jet nozzle that has a relatively simple mechanism capable of jetting high-pressure gas for a long period.

A gas jet nozzle according to the present invention jets high-pressure gas from a high-pressure gas reservoir. The nozzle has a jet port for jetting high-pressure gas by communicating with the gas reservoir. The nozzle further has a jet passage for directing to a target the gas jetted from the jet port and jetting the directed gas from the front end of the passage. The nozzle includes an air suction part for sucking atmospheric air into the gas jetted from the jet port.

When the high-pressure gas in the reservoir is jetted from the jet port, the air suction part sucks atmospheric air. The jetted gas is mixed with the sucked air. The mixed gas passes through the jet passage and is jetted at a high flow rate from the front end of the passage. This makes it possible to jet a mixture of high-pressure gas and atmospheric air even if high-pressure gas is jetted from the jet port at a flow rate lower than in the conventional gas jet nozzles. Because a mixture of high-pressure gas and atmospheric air is jetted, it is possible to greatly reduce the amount of jetted high-pressure gas, with the jet flow rate equal to or higher than that of the conventional gas jet nozzles. This makes it possible to greatly decrease the frequency of the replacement of the gas reservoir, thereby making the replacement less troublesome and greatly cutting down costs.

If the gas jet nozzle according to the present invention is applied to a dust blower, the blower does not need to be fitted with a complex pressure reducing mechanism as fitted to the conventional dust blower. This makes it possible to lengthen the life of the high-pressure gas reservoir of the dust blower by means of a cheap and simple mechanism, without enlarging the blower.

The air suction part may have a rear air intake port backward of the jet port and a front air intake port forward of the jet port. The high-pressure gas jetted from the jet port is mixed with the atmospheric air sucked through the rear air intake port into the air suction part. When the mixed gas enters the jet passage, it is further mixed with the atmospheric air sucked through the front air intake port into the air suction part. The further mixed gas is jetted at a higher flow rate. This makes it possible to further reduce consumption of high-pressure gas, with the jet flow rate equal to or higher than that of the conventional gas jet nozzles.

The air suction part may have a plurality of air intake ports formed around the axis of the jet port. The high-pressure gas jetted from the jet port is mixed with the atmospheric air sucked through these air intake ports into the air suction part. The mixed gas is jetted at a higher flow rate. This makes it possible to further reduce consumption of high-pressure gas, with the jet flow rate equal to or higher than that of the conventional gas jet nozzles.

BEST MODE OF CARRYING OUT THE INVENTION

Figure 1:
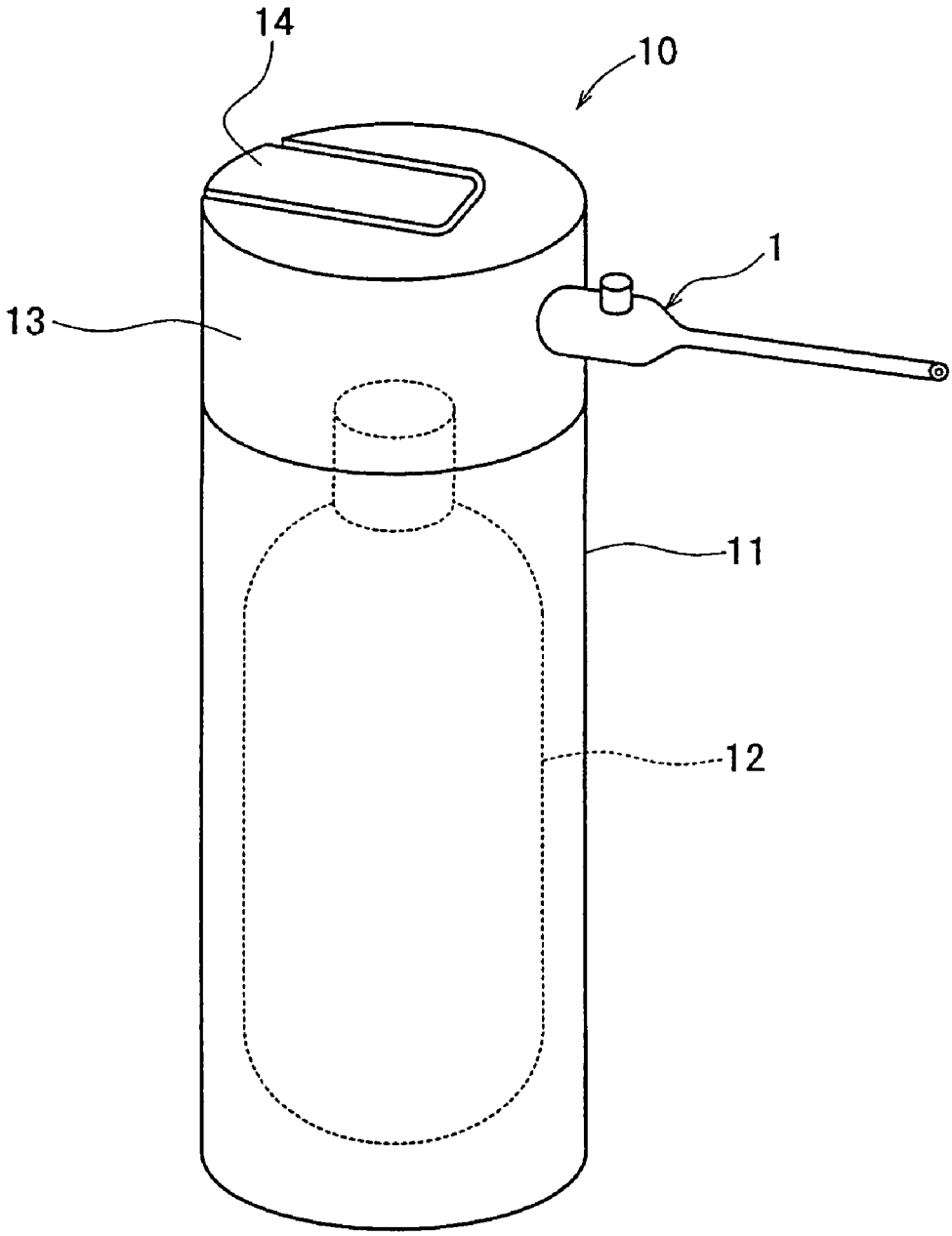
FIG. 1 is a perspective view of a dust blower to which the present invention is applied.

FIG. 1 shows a dust blower 10 including a gas jet nozzle 1 according to a first embodiment of the present invention. The blower 10 further includes a cylindrical casing 11, a high-pressure gas bottle 12 as a high-pressure gas reservoir, a cylindrical gas ejector 13, and a jet button 14.

The gas bottle 12 is put in the casing 11. The gas ejector 13 is fitted to the top of the casing 11 and includes a valve mechanism (not shown) for jetting out the high-pressure gas in the bottle 12. The jet button 14 is fitted to the top of the ejector 13 and can be pressed to open the valve mechanism. The nozzle 1 is fitted to the cylindrical wall of the ejector 13, which ejects high-pressure gas from the bottle 12 through the gas jet nozzle 1.

It is preferable that the critical temperature of the high-pressure gas filled into the high-pressure bottle 12 be 30-430 degrees K. The bottle 12 can be filled with gas either compressed under high pressure or liquefied. It is preferable that the liquefied gas should have a pressure of 0.2 or more MPa at normal temperature.

It is preferable that the high-pressure gas filled into the high-pressure bottle 12 be nitrogen, helium, carbonic acid gas, air, or the like. The high-pressure gas may be HFC-134a, HFC-152a, dimethyl ether, or the like.

Figure 2:
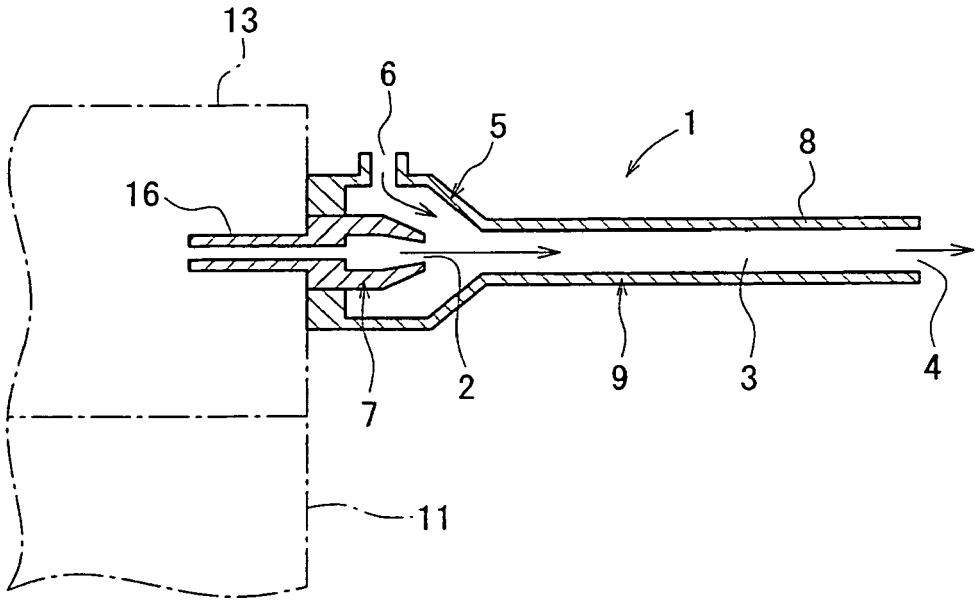
FIG. 2 is a sectional view of a gas jet nozzle according to a first embodiment of the present invention.

FIG. 2 shows the gas jet nozzle 1 according to the first embodiment. This nozzle I has a jet port 2, a jet passage 3, and an air suction part 5.

When the jet port 2 communicates with the high-pressure gas bottle 12, high-pressure gas is jetted from the port 2. The jet passage 3 directs the jetted gas to a target. The directed gas is jetted from the front end 4 of the jet passage 3. The gas jetted from the jet port 2 is mixed with the air sucked into the suction part 5.

More specifically, when the jet button 14, which is fitted to the top of the gas ejector 13, is pressed, the valve mechanism in the ejector 13 opens. This makes the gas jet nozzle 1 communicate with the high-pressure gas bottle 12, so that the nozzle 1 jets high-pressure gas from the jet port 2.

The gas jet nozzle 1 includes a first/inner nozzle 7 and a second/outer nozzle 9. The front end of the first nozzle 7 is the jet port 2. The second nozzle 9 covers a front end portion of the first nozzle 7 and extends forward from the jet port 2. The second nozzle 9 has a tapered bore portion bounding a part of the jet passage 3. The let port 2 is positioned in the tapered bore portion on the second nozzle 9.

The first nozzle 7 includes a communication pipe 16 extending backward and communicating with the valve mechanism. The high-pressure gas ejected from the high-pressure gas bottle 12 is jetted forward (to the right in FIG. 2) through the valve mechanism and the communication pipe 16 from the jet port 2, which is the front end of the first nozzle 7.

The second nozzle 9 includes the air suction part 5 and a nozzle pipe 8. The suction part 5 surrounds the front end portion of the first nozzle 7. The nozzle pipe 8 extends forward from the suction part 5. The suction part 5 has an air intake port 6 formed through its peripheral wall. The suction part 5 sucks in atmospheric air through the intake port 6 and mixes the sucked air with the gas jetted from the jet port 2. The mixed gas is jetted forward from the nozzle pipe 8.

When high-pressure gas in the high-pressure gas bottle 12 is jetted from the jet port 2, the air pressure around the jetted gas drops, so that atmospheric air is sucked through the air intake port 6 into the air suction part 5. The jetted gas and the sucked air are mixed together in the suction part 5. The mixed gas passes through the jet passage 3, where its flow rate increases, and is then jetted from the front end 4 of the passage 3.

As a result, even if the flow rate of the gas jetted from the jet port 2 is lower than in the conventional dust blower, a mixture of high-pressure gas and atmospheric air is jetted from the port 2. The air greatly raises the flow rate of the high-pressure gas. This makes it possible to further reduce consumption of high-pressure gas, with the jet flow rate equal to or higher than that of the conventional dust blower. Accordingly, it is possible to greatly lower the frequency at which the high-pressure gas bottle 12 is replaced, reduce the trouble in replacing the bottle 12, and greatly reduce costs. The dust blower 10 needs to have no complicated pressure reducing mechanism. It is possible to lengthen the life of the bottle 12 by means of a cheap and simple mechanism without enlarging the blower 10.

Figure 3:
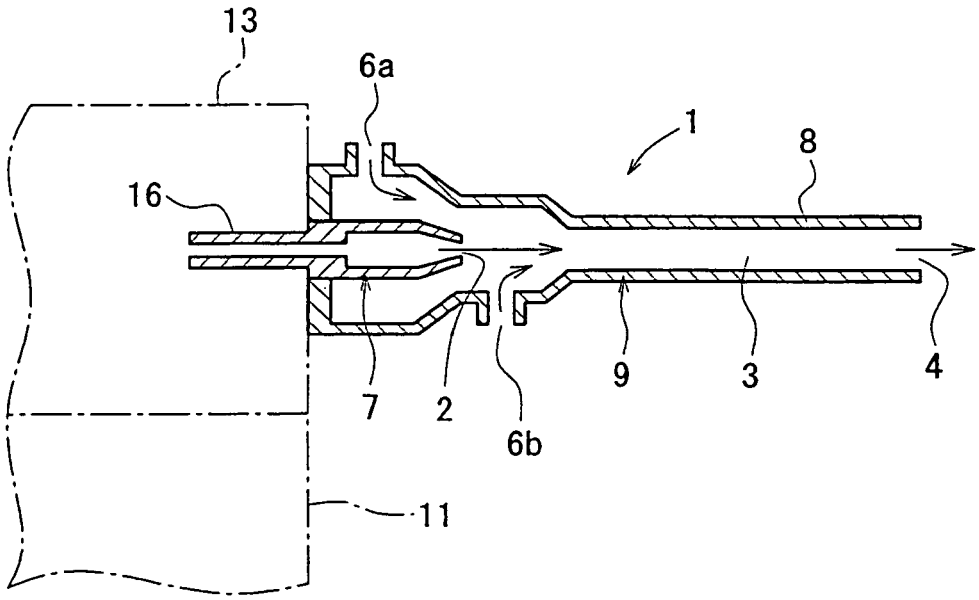
FIG. 3 is a sectional view of a gas jet nozzle according to a second embodiment of the present invention.

FIG. 3 shows a gas jet nozzle 1 according to a second embodiment of the present invention. The air suction part 5 of this nozzle 1 has a rear air intake port 6*a* and a front air intake port 6*b* formed through its peripheral wall. The intake ports 6*a* and 6*b* are backward and forward respectively of the jet port 2 and opposite to each other radially of the nozzle.

The suction part 5 might have two or more rear air intake ports 6*a* and two or more front air intake ports 6*b* that are backward and forward respectively of the jet port 2. These intake ports 6*a* and 6*b* might alternate around the axis of the suction part 5.

Otherwise, this embodiment is similar in structure to the first embodiment. The parts of this embodiment that are similar to the counterparts in the first embodiment are assigned the same reference numerals as the counterparts are assigned.

The gas jetted from the jet port 2 is mixed with the air sucked into the rear air intake port 6*a*, which is backward of the jet port 2. When the mixed gas enters the jet passage 3, it is further mixed with the air sucked into the front air intake port 6*b*, which is forward of the jet port 2. As a result, the gas jet nozzle 1 jets the mixed gas at a higher flow rate. This makes it possible to further reduce consumption of high-pressure gas, with the jet flow rate equal to or higher than that of the conventional dust blower.

Because the two air intake ports 6*a* and 6*b* are opposite to each other radially of the air suction part 5, they are positioned uniformly around the axis of this part 5. This uniformizes the pressure in the suction part 5 so as to equally mix high-pressure gas and atmospheric air before the mixture is jetted out. This would also be the case with the suction part 5 having two or more rear air intake ports 6*a* and two or more front air intake ports 6*b* that are backward and forward respectively of the jet port 2, and that alternate around the axis of the suction part 5.

Otherwise, this embodiment has effects similar to those of the first embodiment.

Figure 4:
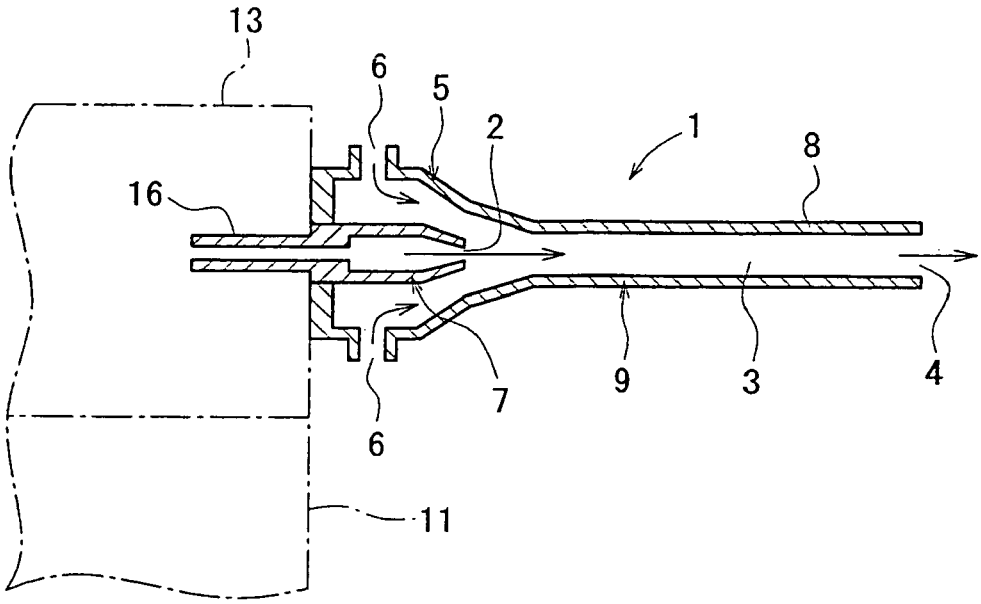
FIG. 4 is a sectional view of a gas jet nozzle according to a third embodiment of the present invention.

FIG. 4 shows a gas jet nozzle 1 according to a third embodiment of the present invention. The air suction part 5 of this nozzle 1 has air intake ports 6 formed through its peripheral wall. The intake ports 6 are spaced at regular intervals around the axis of the suction part 5, along which the first nozzle 7 jets high-pressure gas.

Otherwise, this embodiment is similar to the first embodiment. The parts of this embodiment that are similar to the counterparts in the first embodiment are assigned the same reference numerals as the counterparts are assigned.

These intake ports 6 are arranged around the axis of the air suction part 5, along which the first nozzle 7 jets high-pressure gas. The gas jet nozzle 1 sucks atmospheric air through the intake ports 6. The gas jetted from the first nozzle 7 is mixed with the sucked air. The mixed gas is jetted out at a higher flow rate than by the first and second embodiments. This makes it possible to further reduce consumption of high-pressure gas, with the jet flow rate equal to or higher than that of the conventional dust blower. Because the intake ports 6 are spaced at regular intervals around the axis of the suction part 5, the pressure in this part is uniform, so that high-pressure gas and atmospheric air can be mixed more equally before the mixture is jetted out.

Otherwise, this embodiment has effects similar to those of the foregoing embodiments.

Figure 5:
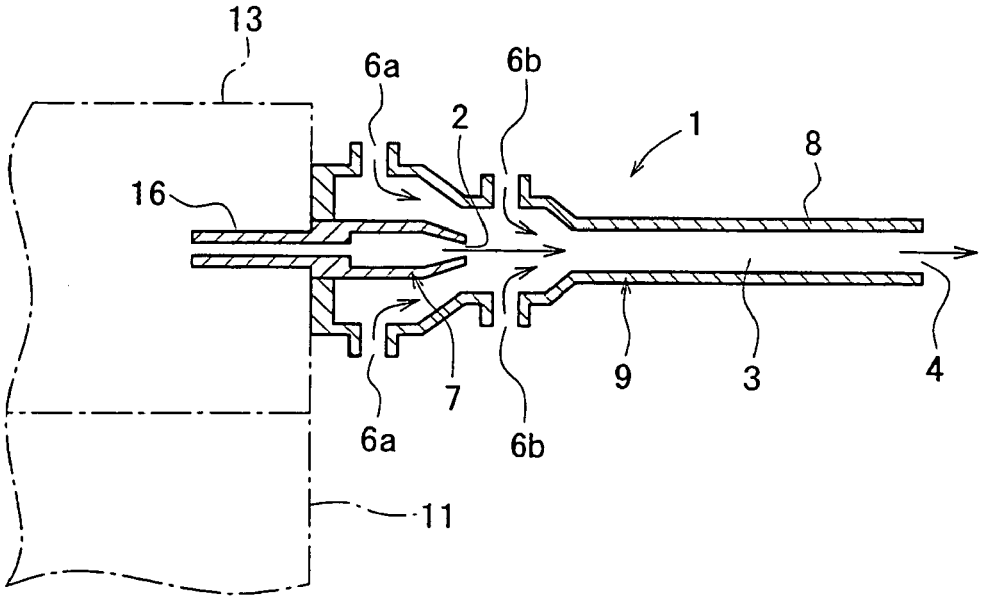
FIG. 5 is a sectional view of a gas jet nozzle according to a fourth embodiment of the present invention.

FIG. 5 shows a gas jet nozzle 1 according to a fourth embodiment of the present invention. The air suction part 5 of this nozzle 1 has rear air intake ports 6*a* and front air intake ports 6*b* formed through its peripheral wall. The rear air intake ports '6*a* are backward of the jet port 2 and spaced at regular intervals around the axis of the suction part 5, along which the first nozzle 7 jets high-pressure gas. The front air intake ports 6*b* are forward of the jet port 2 and spaced at regular intervals around the axis of the suction part 5.

Otherwise, this embodiment is similar in structure to the first embodiment. The parts of this embodiment that are similar to the counterparts in the first embodiment are assigned the same reference numerals as the counterparts are assigned.

The gas jetted from the jet port 2 is mixed with the air sucked into the rear air intake port 6*a*, which is backward of the jet port 2. When the mixed gas enters the jet passage 3, it is further mixed with the air sucked into the front air intake port 6*b*, which is forward of the jet port 2. As a result, the gas jet nozzle 1 jets the mixed gas at a higher flow rate. This makes it possible to further reduce consumption of high-pressure gas, with the jet flow rate equal to or higher than that of the conventional dust blower.

Because the rear air intake ports 6*a* are spaced at regular intervals around the axis of the suction part 5, and because the front air intake ports 6*b* are spaced at regular intervals around this axis, the pressure in the suction part 5 is uniform so that high-pressure gas and atmospheric air can be mixed more equally before the mixture is jetted out.

Otherwise, this embodiment has effects similar to those of the foregoing embodiments.

Figure 6:
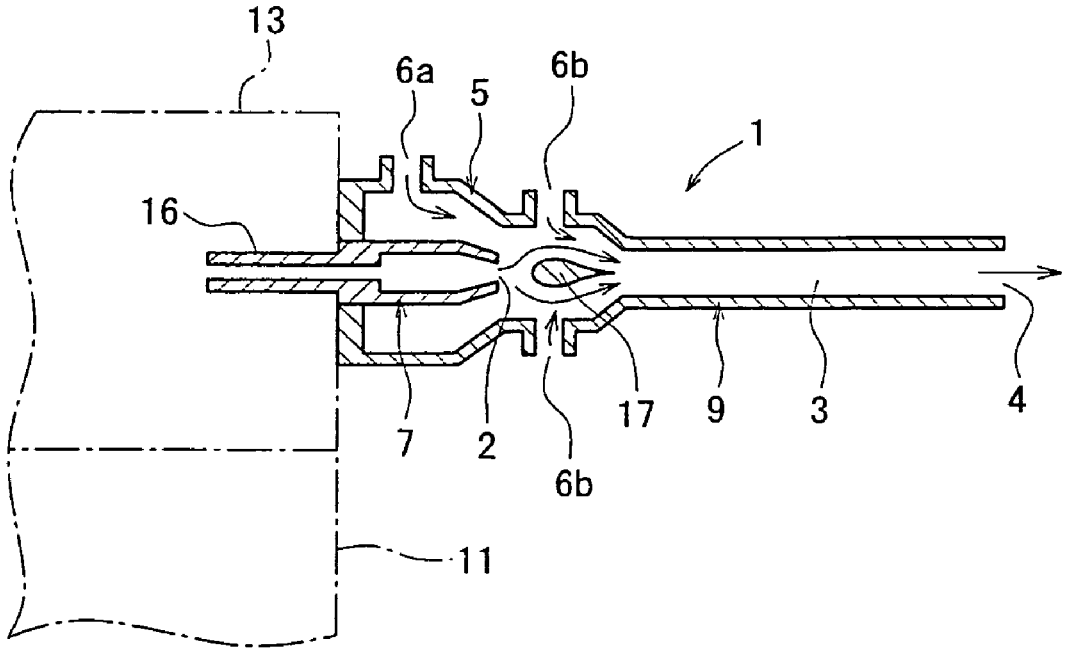
FIG. 6 is a sectional view of a gas jet nozzle according to a fifth embodiment of the present invention.

FIG. 6 shows a gas jet nozzle 1 according to a fifth embodiment of the present invention. The air suction part 5 of this nozzle 1 has a rear air intake port 6*a* and two front air intake ports 6*b* formed through its peripheral wall. The rear air intake port 6*a* is backward of the jet port 2. The front air intake ports 6*b* are forward of the jet port 2.

This nozzle 1 is fitted with a streamline member 17 in front of the jet port 2. The streamline member 17 has an upper streamline side and an under streamline side, each of which is faced by one of the front air intake ports 6*b*.

The air suction part 5 of this nozzle 1 might have no rear air intake port 6*a*.

Otherwise, this embodiment is similar to the first embodiment. The parts of this embodiment that are similar to the counterparts in the first embodiment are assigned the same reference numerals as the counterparts are assigned.

The gas jetted from the jet port 2 is mixed with the air sucked into the rear air intake port 6*a*, which is backward of the jet port 2. Before the mixed gas enters the jet passage 3, it passes along the upper and under sides of the streamline member 17, which is positioned in front of the jet port 2. When the mixed gas passes along the streamline sides, its pressure falls, so that atmospheric is sucked through the front air intake ports 6*b* into the air suction part 5. The mixed gas is further mixed with the air sucked through these intake port 6*b*. As a result, this nozzle 1 jets the mixed gas at a higher flow rate. This makes it possible to further reduce consumption of high-pressure gas, with the jet flow rate equal to or higher than that of the conventional dust blower.

Otherwise, this embodiment has effects similar to those of the foregoing embodiments.

Figure 7:
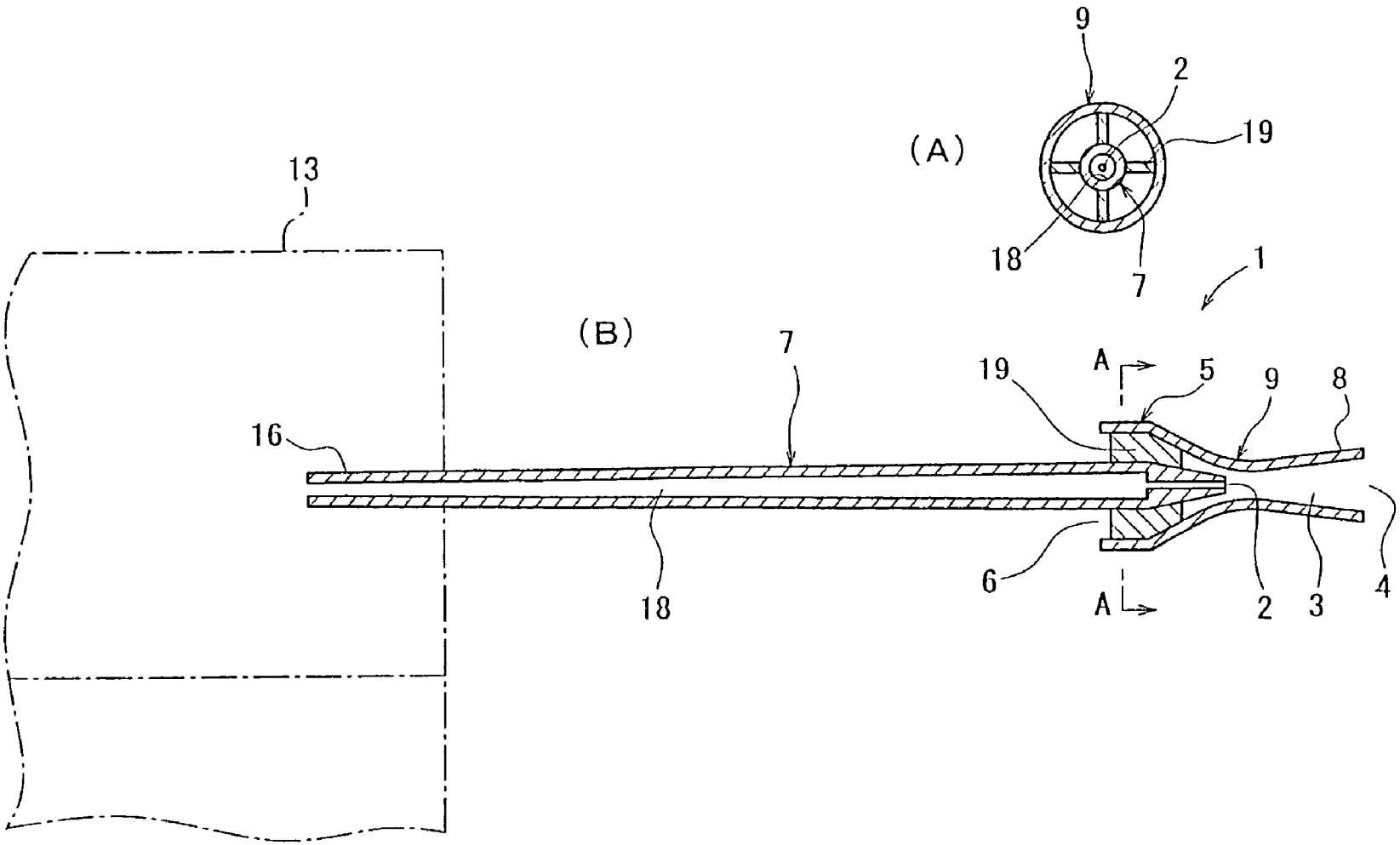
FIG. 7 is a sectional view of a gas jet nozzle according to a sixth embodiment of the present invention.

FIG. 7 shows a gas jet nozzle 1 according to a sixth embodiment of the present invention. This nozzle 1 includes a first nozzle 7 and a second nozzle 9. The first nozzle 7 is connected to a gas ejector 13. The second nozzle 9 is fitted to the front end of the first ejector 7.

A rear end portion of the first nozzle 7 functions as a communication pipe 16, which is inserted into the gas ejector 13 and communicates with the valve mechanism of the ejector. The first nozzle 7 has a gas passage 18 formed in it, which is larger in diameter toward its front end. The first nozzle 7 further has a jet port 2 formed at its front end. The jet port 2 is smaller in diameter than the front end of the passage 18.

The gas passage 18 might be smaller in diameter toward its front end or constant in diameter.

The rear end of the second nozzle 9 is fixed to the front end of the first nozzle 7. The second nozzle 9 has an open front end 4 and includes a rear part and a front part, which are connected by a narrow part. The rear part includes a front portion narrower toward the front end of this part. The front part is wider toward its front end.

Four radial fitting plates 19 are fitted in the rear part of the second nozzle 9 and engage with the outer peripheral surface of the first nozzle 7. The fitting plates 19 are spaced at intervals of 90 degrees around the axis of the second nozzle 9. The fitting plates 19 may be formed of an elastic material such as rubber or a resin that can engage precisely. This makes it possible to fit the second nozzle 9 to the first nozzle 7 by frictional force, and also fit the second nozzle 9 to first nozzles 7 that are slightly different in outer diameter.

The rear part of the second nozzle 9 might be fitted with three, five or more fitting plates 19, which should preferably be radial of this nozzle.

The second nozzle 9 is fixed to the front end of the first nozzle 7, with the jet port 2 positioned near the narrow part of the second nozzle 9. Specifically, the jet port 2 is slightly backward of the narrow part.

The rear end of the second nozzle 9 functions as an air intake port 6. Atmospheric air flows into the intake port 6 and through the spaces between the fitting plates 19. When the gas jetted from the jet port 2 passes through the narrow part of the second nozzle 9, the air pressure around the jetted gas near this part falls, so that atmospheric air is sucked through the intake port 6 into the suction part 5. The gas jetted from the jet port 2 is mixed with the sucked air. The mixed gas passes through the jet passage 3 and is jetted from the front end 4 of the second nozzle 9 at a high flow rate.

The second nozzle 9 is fitted removably to the front end of the long first nozzle 7. This makes it easy to switch the gas jet nozzle 1 to a gas saving mode. The jet passage 3 of the second nozzle 9 is wider toward its front end. Accordingly, if the gas jet nozzle 1 is applied to a dust blower, the blower can blow dust off efficiently in a large gas quantity. The jet port 2 is slightly backward of the narrow part of the second nozzle 9 so that a jet flow can be created near this part. As a result, atmospheric air can be sucked effectively through the air intake port 6 by the air pressure drop around the jet flow. This makes it possible to jet mixed gas at a high flow rate from the front end 4 of the second nozzle 9. Accordingly, if the gas jet nozzle 1 is applied to a dust blower, the blower can efficiently blow dust off. The second nozzle 9 is roughly tubular with a narrow part, and its rear end functions as an air intake port 6. This makes it possible to suck atmospheric air smoothly into the second nozzle 9. The second nozzle 9 is roughly tubular with a narrow part and relatively simple in shape. This makes the second nozzle 9 easy to mold and advantageous in terms of cost.

Gas jet tests were carried out on the gas jet nozzle 1 shown in FIG. 7. The jet port 2 of this nozzle 1 had a diameter of 0.9 mm.

Without the second nozzle 9 fitted to the first nozzle 7, and with mixed gas jetted from the jet port 2 at flow rates of 11, 22, and 33 NL/min, the flow rates at the front end of the gas jet nozzle 1 were measured. The measured rates were 11, 22, and 33 NL/min, which are equal to the flow rates at which the gas was jetted.

With the second nozzle 9 fitted to the first nozzle 7, and with mixed gas jetted from the jet port 2 at the flow rate of 11 NL/min, the flow rate at the front end of the gas jet nozzle 1 was measured. The measured rate was 32 NL/min, which is 291% of 11 NL/min.

With the second nozzle 9 fitted to the first nozzle 7, and with mixed gas jetted from the jet port 2 at the flow rate of 22 NL/min, the flow rate at the front end of the gas jet nozzle 1 was measured. The measured rate was 56 NL/min, which is 255% of 22 NL/min.

With the second nozzle 9 fitted to the first nozzle 7, and with mixed gas jetted from the jet port 2 at the flow rate of 33 NL/min, the flow rate at the front end of the gas jet nozzle 1 was measured. The measured rate was 74 NL/min, which is 224% of 33 NL/min.

Figure 8:
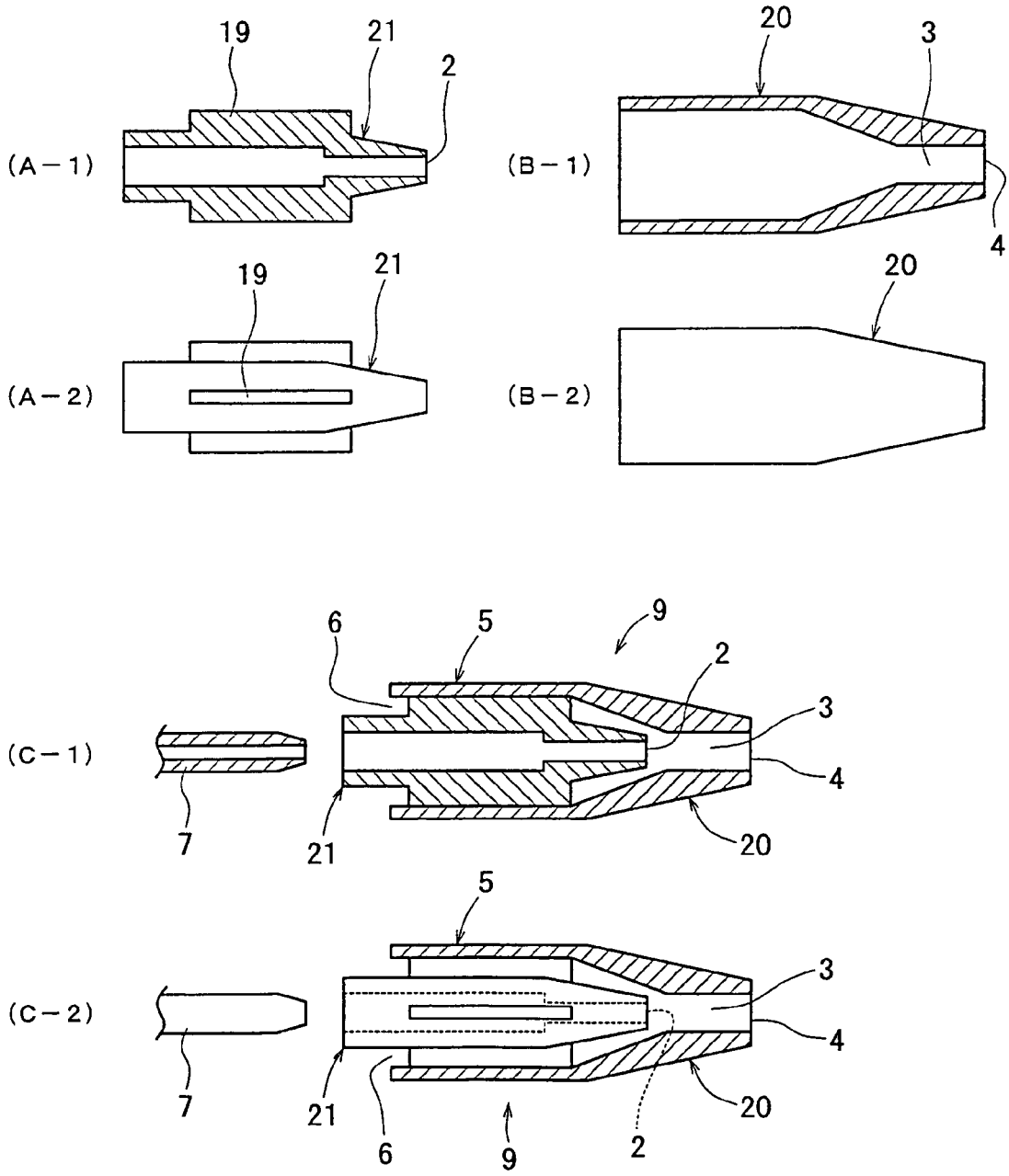
FIG. 8 is a sectional view of a gas jet nozzle according to a seventh embodiment of the present invention.

FIG. 8 shows a gas jet nozzle 1 according to a seventh embodiment of the present invention. This nozzle 1 includes a first nozzle 7 and a second nozzle 9. The first nozzle 7 is long and connected to a gas ejector (not shown). The second nozzle 9 is fitted to the front end of the first nozzle 7.

The second nozzle 9 consists of an outer nozzle 20 and an inner nozzle 21, which fits into the outer nozzle. The outer nozzle 20 consists of a cylindrical rear part and a conical front part tapering toward its front end. The front part has a jet passage 3 formed through its front end portion and bounded by an inner peripheral surface. The inner nozzle 21 is roughly cylindrical and has four radial fitting plates 19 formed on its outer peripheral surface. The fitting plates 19 engage with the inner peripheral surface of the outer nozzle 20. The fitting plates 19 are spaced at intervals of 90 degrees around the axis of the inner nozzle 21.

The inner nozzle 21 might have three, five or more fitting plates 19, which should preferably be radial of this nozzle.

The rear end of the outer nozzle 20 functions as an air intake port 6, through which atmospheric air can be sucked. The sucked air flows through the spaces between the fitting plates 19 to and through the front end of the jet passage.

With a front end portion of the first nozzle 7 inserted into the rear end of the inner nozzle 21, the front end of the inner nozzle 21 functions as a jet port 2 communicating with the high-pressure gas bottle.

When the high-pressure gas from the high-pressure gas bottle is jetted from the jet port 2 of the inner nozzle 21, so that a jet flow passes through the jet passage 3 of the second nozzle 9, the air pressure around the jet flow falls. This causes atmospheric air to be sucked through the air intake port 6 into the air suction part 5. The gas jetted from the jet port 2 is mixed with the sucked air. The mixed gas passes through the jet passage 3 and is jetted at a high flow rate from the front end 4 of the second nozzle 9.

With reference to FIG. 8, the second nozzle 9 can be fitted removably to the front end of the long first nozzle 7. This makes it easy to switch the gas jet nozzle to a gas saving mode. The jet port 2 of the inner nozzle 21 is positioned in the tapered bore portion in the outer nozzle 20. The gas jetted from the jet port 2 flows at a higher speed in the tapered bore portion, so that atmospheric air is sucked effectively into the air suction part 5.

With reference to FIG. 8, a front end portion of the first nozzle 7 might have the same shape as the inner nozzle 21 has, and the front end of the first nozzle 7 might be a jet port 2. The outer nozzle 20 might be fitted directly to the front end portion of the first nozzle 7.

In each of the embodiments, the high-pressure gas is not limited in particular but may be a mixture of compressed gas and liquid or another fluid, or be another fluid.

The gas jet nozzle according to the present invention can be applied to not only dust blowers but also various products that jet high-pressure gas. This nozzle can be applied to not only products for use with a high-pressure gas bottle but also aerosol products.

The invention claimed is:

1. A gas jet nozzle for jetting high-pressure gas from a high-pressure gas reservoir, the nozzle having a front and back and comprising:

an inner nozzle with a jet port for jetting high-pressure gas by communicating with the gas reservoir, the inner nozzle having an outer peripheral surface and an axis;

an outer nozzle with a jet passage, bounded by an inner peripheral surface, for directing to a target the gas jetted from the jet port and jetting the directed gas from a front end of the jet passage, the outer nozzle having a tapered bore portion bounding a part of the jet passage; and an air suction part for sucking atmospheric air into the gas jetted from the jet port, the jet port on the inner nozzle residing within the tapered bore portion so as to cause jetted gas from the jet port to be accelerated at the tapered bore portion, wherein a plurality of radial fitting plates are formed on the outer peripheral surface of the inner nozzle, the fitting plates engaging with the inner peripheral surface of the outer nozzle and spaced at intervals around the axis of the inner nozzle, a rear end of the outer nozzle functioning as an air intake port of the air suction part, through which atmospheric air can be sucked, the sucked air flowing through the spaces between the fitting plates to and through the front end of the jet passage.

2. A gas jet nozzle as claimed in claim 1, wherein the gas jet nozzle has a central axis extending in a front-to-back direction, and the air suction part has a plurality of air intake ports formed around the axis of the jet port.

* * * * *